United States Patent [19]

Portnoy

[11] Patent Number: 4,991,811

[45] Date of Patent: Feb. 12, 1991

[54] COMPACTLY STACKABLE CAKE PLATTERS

[75] Inventor: Tanchum G. Portnoy, Jamaica Estates, N.Y.

[73] Assignee: MIA Industrial Group Ltd., Bronx, N.Y.

[21] Appl. No.: 396,909

[22] Filed: Aug. 22, 1989

[51] Int. Cl.[5] ..... F16M 13/00

[52] U.S. Cl. ..... 248/346; 206/505

[58] Field of Search ..... 248/346; 220/8, 93; D7/672, 673, 610; 206/45.32, 505, 507

[56] References Cited

U.S. PATENT DOCUMENTS

| | | | |
|---|---|---|---|
| D. 79,994 | 11/1929 | Slick . | |
| D. 81,306 | 6/1930 | Slick . | |
| D. 124,884 | 1/1941 | Wickerham . | |
| D. 135,152 | 3/1943 | Frenger . | |
| D. 155,762 | 10/1949 | Yutzey . | |
| D. 156,860 | 1/1950 | Zaikaner . | |
| D. 189,203 | 11/1960 | Reifers . | |
| D. 214,391 | 6/1969 | Weiss . | |
| 1,718,668 | 6/1929 | Smythe . | |
| 1,961,342 | 6/1934 | De Reamer | 248/346 |
| 1,979,911 | 11/1934 | Steudel | 248/346 X |
| 2,093,307 | 9/1937 | Cline . | |
| 2,109,955 | 3/1938 | Carson . | |
| 2,271,156 | 1/1942 | Walker | 220/8 |
| 2,481,095 | 9/1949 | Essman | 220/8 X |
| 3,330,610 | 7/1967 | Schnabel . | |
| 4,197,940 | 4/1980 | DeRossett | 206/45.32 |

*Primary Examiner*—David L. Talbott

*Attorney, Agent, or Firm*—Amster, Rothstein & Ebenstein

[57] ABSTRACT

A platter is adapted when used to support an article above a support and when stored to be nested with a mating platter to minimize the storage space required to store the platters. The platter comprises a member having a planar upper surface adapted to support the article thereon, and a supporting flange depending from the member and having a continuous lower surface lying substantially in a common plane spaced below the plane of the member lower surface. The dimensions of the member and the dimensions of the corresponding member of the mating platter are substantially the same and the dimensions of the flange and the dimensions of the corresponding flange of the mating platter are different such that the platter and the mating platter can be nested for storage.

26 Claims, 2 Drawing Sheets

COMPACTLY STACKABLE CAKE PLATTERS

BACKGROUND OF THE INVENTION

The present invention relates to platters such as cake platters, and more particularly to platters which may be stacked one on top of the other for storage or transport prior to use.

Cake platters are employed in homes, bakeries and the like in order to support a cake or like bakery-type food article above a support such as a table top, display tray, or the like, and thereby facilitate removal of the cake from the support. Essentially, a cake platter is comprised of a plate having a substantially planar upper surface adapted to support the cake and one or more depending members extending downwardly from the undersurface of the plate and providing a substantially planar lower surface adapted to rest on the support. Some cake platters employ as the depending member a continuous closed flange or shoulder (e.g., an annular flange) depending from the undersurface of the plate, disposed coaxially about a central axis transverse to the plate, and having a lower surface defining a plane; other cake platters employ as the depending member a spaced plurality of lugs depending from the undersurface of the plate and together defining by their lower surfaces a common plane. Cake platters employing as the depending member a continuous closed flange tend to exhibit greater stability when resting on the support than those employing a spaced plurality of lugs, and the present invention is directed only to those cake platters employing as the depending member such a continuous closed flange.

The flange is desirably of a height such that during use of the platter the plate is sufficiently spaced above the support to enable the user to easily slip his fingers underneath portions of the plate, thereby to facilitate removal of the platter and any article thereon from the support. However, the higher the flange, and hence the entire cake platter, the more storage space is required for the cake platter. The height of the cake platter is a matter of considerable importance not only to the bakeries which must store the cake platters in large quantities prior to use (that is, when they do not have cakes thereon), but also the cake platter manufacturers who must not only store, but also transport, the cake platters to the bakeries. To put the matter in perspective, even a small bakery may employ hundreds of cake platters a day, while a cake platter manufacturer may be shipping many thousands a day. Accordingly, any substantial reduction in the space required to stack the cake platters for storage and transport is highly desirable.

Accordingly, it is an object of the present invention to provide platters, such as cake platters, which are compactly storable.

Another object is to provide such platters which are easy and inexpensive to manufacture and of sturdy one-piece integral construction.

A further object is to provide such platters which optionally have non-slip upper surfaces and guides for cutting articles thereon into segments of equal area.

SUMMARY OF THE INVENTION

It has now been found that the above-related objects of the present invention are obtained in a platter adapted when used to support an article above a support and when stored to be nested with a mating platter to minimize the storage space required to store the platters. The platter comprises a member having a planar upper surface adapted to support the article thereon, and a supporting flange depending from the member and having a continuous lower surface lying substantially in a common plane spaced below the plane of the member lower surface. The dimensions of the member and the dimensions of the corresponding member of the mating platter are substantially the same and the dimensions of the flange and the dimensions of the corresponding flange of the mating platter are different such that the platter and the mating platter can be nested for storage, preferably with the flange of the platter nested within the corresponding flange of the mating platter.

In a preferred embodiment the platter is an injection-molded, homogeneous, one-piece integral construction of a plastic selected from the group consisting of polypropylene, polystyrene and polyethylene. The member upper surface are non-slip surfaces, and at least segments of the flange are disposed substantially inwardly of the member to facilitate grasping of the member when the platter rests on the support. The flange defines a continuous, closed hollow shape, preferably a circular annulus, with the flange lower surface spaced by about one centimeter from the member upper surface.

Optionally the member lower surface defines a plurality of equiangularly-disposed linear ribs extending radially outwardly from the center thereof at least as far as the flange, the positions of the ribs being detectable from above the member to permit the ribs to function as guidelines for dividing an article on the member upper surface into aliquots of like area.

The present invention also encompasses a pair of nested food platters, each of the platters being adapted to support a food item above a support. Each platter comprises a plate having a lower surface and a generally planar upper surface adapted to support the food item thereon, and a flange depending from the plate lower surface and having a lower surface defining a plane spaced below the plate lower surface to space the plate above the support. The plate defines a perimeter, and the flange defines an inner perimeter and an outer perimeter. The pair of platters have Plate perimeters of generally like dimensions and flange perimeters of appreciably different dimensions enabling the flange of one of the platters to be nested within the flange of the other of the platters, thereby to enable the platters to be compactly stacked.

In a preferred embodiment, in each of the platters the flange lower surface is equally spaced from the plate upper surface, preferably by about one centimeter, and the height of the flange spaces the plate lower surface from the flange lower surface. In the nested pair, substantially the entire height of the flange of the one platter is telescopically received within the height of the flange of the other platter, the outer flange perimeter of the one platter being received within the inner flange perimeter of the other platter.

DETAILED DESCRIPTION OF THE PREFERRED EMBODIMENTS

Figure 1:
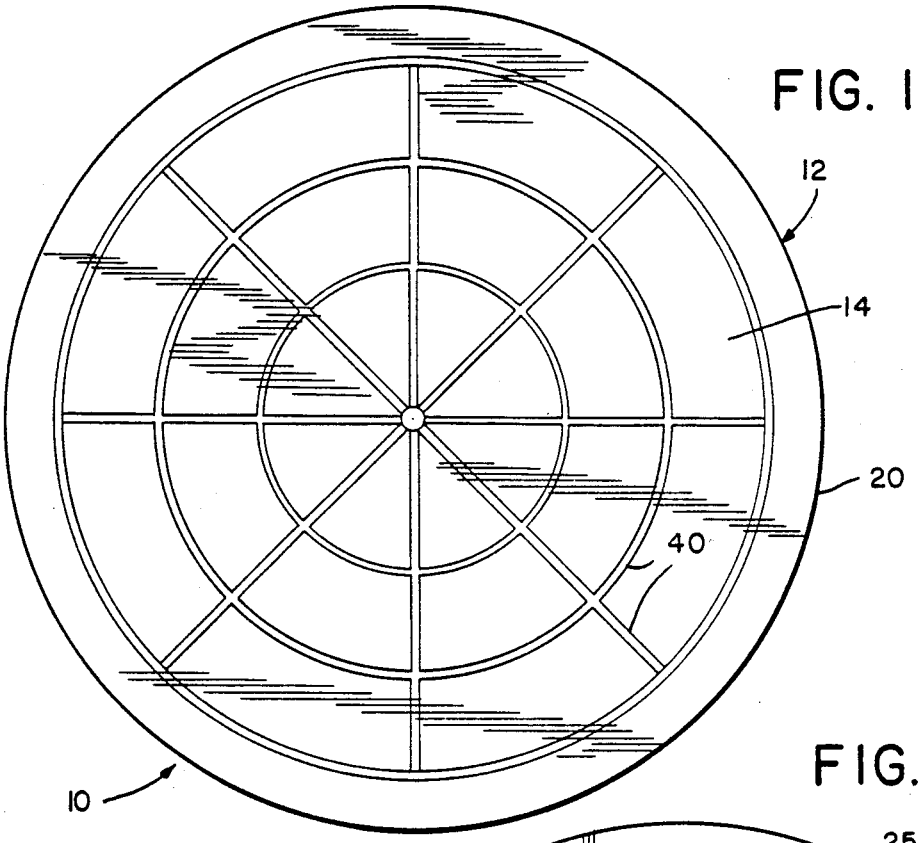
FIG. 1 is a top plan view of a platter according to the present invention.
Figure 2:
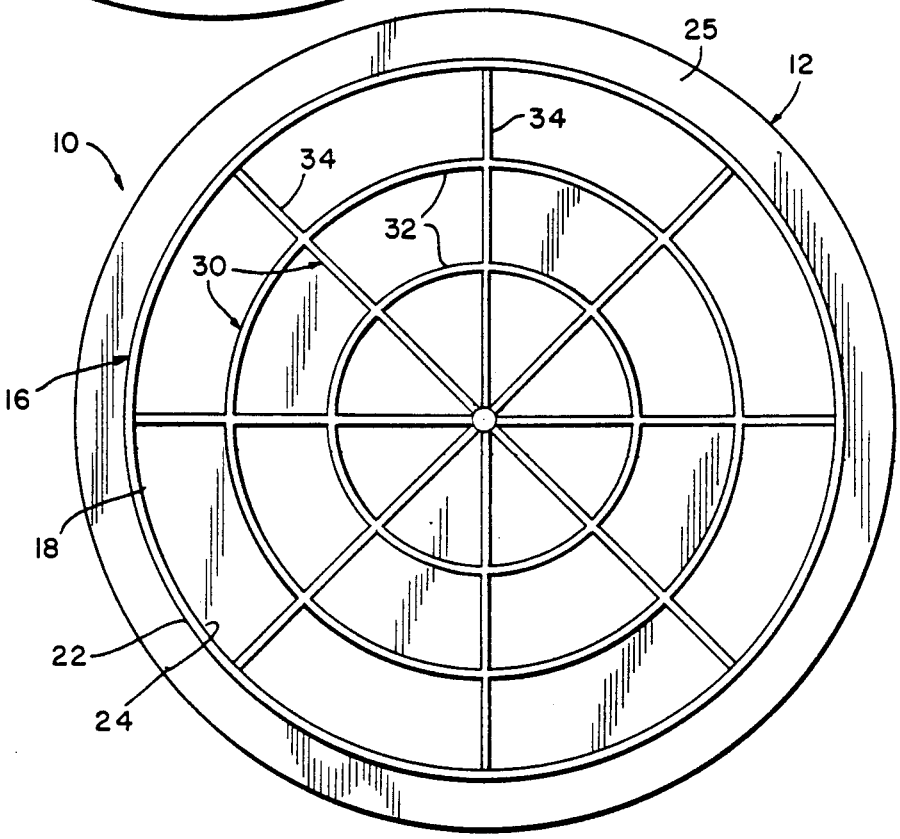
FIG. 2 is a bottom plan view thereof.

Referring now to the drawing, and in particular to FIGS. 1 and 2 thereof, therein illustrated is a single platter according to the present invention, generally designated by the reference numeral 10. The platter 10 comprises a plate generally designated 12 defining a substantially planar upper surface 14, and a flange 18 in a continuous closed hollow configuration defining a continuous substantially planar lower surface 16. The plate upper surface 14 is adapted to support thereon an article such as a food item—e.g., a cake (not shown)—while the flange lower surface 18 is adapted to support the platter on a support (not shown)—e.g., a table top or cake display.

Although plate 12 is illustrated as being of a generally circular configuration, clearly polygonal and other configurations may be used as well. Irrespective of the particular configuration of the plate 12, the perimeter 20 thereof and the adjacent upper surface margin may be scalloped, laced, or provided with other ornamental features. While the flange 16 is illustrated as being of circular or annular configuration, clearly polygonal and other continuous closed configurations defining therein a void or hollow may be used as well—for example, ellipses, ovals, and the like —although, for reasons which will become apparent hereinafter, a circular or annular configuration is preferred.

The flange 16 defines an outer perimeter 22 and an inner perimeter 24. At least portions of the outer flange perimeter 22 are spaced inwardly from the plate perimeter 20 so that at least portions of the plate 12 define outwardly projecting ledges relative to the flange 16, thereby facilitating handling of the platter and more particularly its being lifted by the ledge portions of the plate 12 when the flange lower surface 18 is resting on a support. As long as at least one such ledge is provided, and preferably a plurality of ledges or a continuous ledge about the plate perimeter 20 (as illustrated), the flange perimeter dimensions may be varied greatly.

The thickness of the flange 16 (that is, the distance between the outer perimeter 22 and the inner perimeter 24) is preferably only about 2 mm, the only requirement being that the flange 16 be sufficiently strong to bear the weight of the plate 12 and any article placed thereon. The height of the flange 16 (that is, the distance between the undersurface 25 of the plate 12 and the lower surface 18 of the flange 16) is preferably about 1 cm, just high enough to enable a person to slide his fingers between the plate undersurface 25 and the support surface on which the flange lower surface 18 rests, so that a ledge of the plate 12 may be easily grasped. Obviously, higher flanges 16 may be employed, if desired for aesthetic or other reasons. The height of the plate 12 (that is, the distance between the plate upper surface 14 and its undersurface 25 where it connects to flange 16) is preferably about 0.2 cm, but a greater or lesser height may be used depending on the ability of the plate 12, (in connection with any strengthening ribs and the like, as discussed hereinafter) to adequately support an article on the plate upper surface 14 without substantial deflection or bending.

The entire platter 10 is simply and economically manufactured by injection molding of a suitable plastic to produce a sturdy, strong and relatively rigid, homogeneous, one-piece integral construction. Polyethylene, polystyrene and polypropylene are examples of preferred inexpensive and relatively rigid plastics for use in injection molding the platter, although other processes and materials may alternatively be employed to form the platter. It will be appreciated that the preferred dimensions recited above for the plate and flange are for the preferred plastics and that smaller or greater dimensions may be used in conjunction with stronger or weaker plastics, respectively. The plate upper surface 14 is preferably of non-slip construction to reduce the likelihood of an article, such as a cake, placed thereon accidentally sliding off. The non-slip construction may be a natural result of the plastics employed in forming the platter or the result of a surface treatment imparted to the upper surface, optionally as part of the molding process, to provide non-slip characteristics.

Within the inner flange perimeter 24, the plate undersurface 25 is preferably provided with a plurality of supporting ribs generally designated 30. The supporting ribs 30 are preferably simply increased thicknesses of the plate 12 on the undersurface 25 thereof. The ribs 30 serve the function of strengthening the central portion of the plate 12—that is, the portion of the plate within the boundary of the inner flange perimeter 24. The ribs 30 may be of various configurations. Preferably the ribs 30 include a spaced apart plurality of concentric circular or ring ribs 32 coaxially disposed within flange 16 about a transverse axis through the center of the plate 12, and a spaced apart plurality of straight or linear ribs 34 extending outwardly from the center of the plate 12 toward the perimeter 20 thereof, but stopping at the inner flange perimeter 24. The ring ribs 32 are preferably generally regularly disposed between the center of the plate 12 and the inner flange perimeter 24, and the linear ribs 34 are preferably generally equiangularly disposed (that is, spaced apart by equal angles). In addition to serving the function of strengthening the plate 12, the ribs 30 also facilitate injection molding of the platter 10.

When the plate 12 is formed of transparent or translucent plastic, or is sufficiently thin to enable the linear ribs 34 to be discerned therethrough, the linear ribs 34 may serve the additional function of acting as cutting guides to enable an article on plate 12 (e.g., a cake) to be cut into segments of equal cross-sectional area. For linear ribs 34 to serve this guide function, the diameter of the article must be less than the diameter of the inner flange 24 as otherwise the article conceals any view of the linear ribs 34 through plate 12. The molding process may be employed to form shallow depressions or grooves 40 on the plate upper surface 14 corresponding to the ribs so that the depressions or grooves 40 aligned with the linear ribs 34 can serve directly as guidelines for cutting the article into segments of equal cross-sectional area. If desired, the depressions or grooves 40 may extend radially outwardly beyond the inner flange perimeter 24 to the plate perimeter 20 so as to be visible even when the plate supports an article larger than flange 16.

Figure 3:
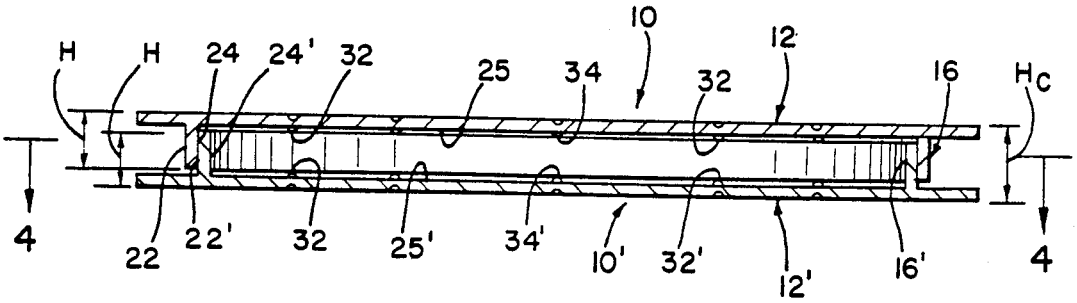
FIG. 3 is a sectional view of a nested pair of platters according to the present invention.
Figure 4:
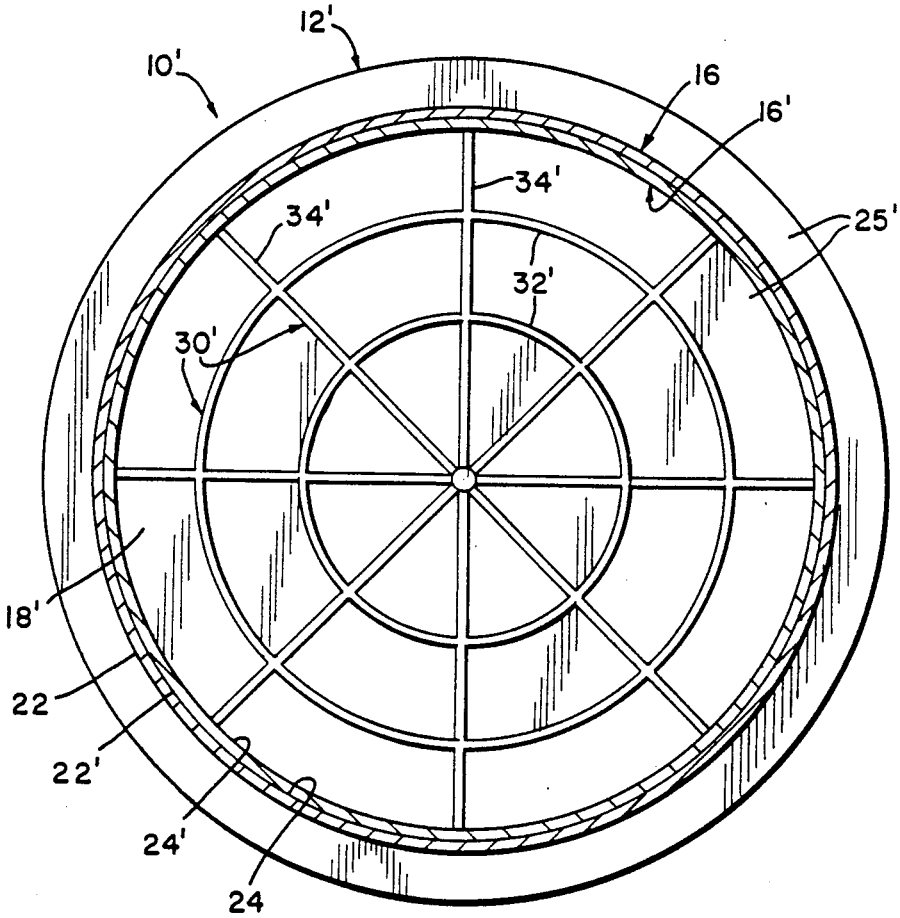
FIG. 4 is a sectional view taken along the line 4-4 of FIG. 3.

Referring now to FIGS. 3 and 4 in particular, therein illustrated are a pair of platters 10, 10' in nested or compactly stacked back-to-back relationship. Platter 10' is identical to previously described platter 10 in all respects save one, and the elements thereof are correspondingly numbered with the same numbers primed. The one respect in which cake platters 10, 10' differ is that the flange 16' of cake platter 10' is sufficiently smaller (i.e., of lesser diameter) than the flange 16 of platter 10 that the outer flange perimeter 22' of platter 10′ may be received within the inner flange perimeter 24 of platter 10, thus enabling the flanges 16, 16′ to be at least partially telescopically disposed. Thus, where platters 10, 10′ are of an equal height H (measured from plate upper surface 14 to flange lower surface 18), the two platters 10, 10′ may be stacked in a combined height $H_c$ which is substantially less, and preferably at least 40% less than the 2H which would be required if the platters 10, 10′ were conventionally stacked in upper surface-to-upper surface or lower surface-to-lower surface or even lower surface-to-upper surface relationship. Accordingly, platters 10, 10′ having article-supporting upper surfaces 14, 14′ of equal dimensions, but flanges 16, 16′ of different dimensions, may be nested or compactly stacked together for storage in telescopic disposition.

This compact storage position enables many more platters to be economically and efficiently stacked in nested pairs in a given volume (for example, 40% more). Disregarding the very slight height of the linear ribs 34 relative to the height of the flange 16, the present invention essentially enables two flanges to be stacked in the height of just one flange. Disregarding the very slight height of the plate 12 relative to the height of the flange 16, the present invention essentially enables two platters to be stored in the height of just one platter.

It will be appreciated, as noted above, that the flanges 16, 16′ are preferably circular so that the platters 10, 10′ need not be carefully angularly positioned relative to one another in order to align the configurations of the flanges 16, 16′ (e.g., by rotation of one platter relative to the other) so as to enable one flange to fit within the other, as might be the case if the flanges were, for example, polygonal.

To summarize, the present invention provides platters which are compactly storable, easy and inexpensive to manufacture, and of sturdy one-piece integral construction.

Now that the preferred embodiments of the present invention have been shown and described in detail, various modifications and improvements thereon will become readily apparent to those skilled in the art. Accordingly, the claims are to be construed broadly and in a manner consistent with the spirit and scope of the invention herein.

I claim:

1. A platter adapted when used to support an article above a support and when stored to be nested back to back with a mating platter to minimize the storage space required to store the platters, comprising a member having a planar upper surface adapted to support the article thereon and a back, and a supporting flange depending from said member and having a continuous lower surface lying substantially in a common plane spaced below the plane of said back; the dimensions of said member and the dimensions of the corresponding member of the mating platter being substantially the same and the dimensions of said flange and the dimensions of the corresponding flange of the mating platter being different such that said platter and the mating platter can be nested back to back for storage.

2. The platter of claim 1 wherein said flange of said platter is nestable within the corresponding flange of the mating platter.

3. The platter of claim 1 wherein said flange defines a continuous, closed hollow shape.

4. The platter of claim 3 wherein said flange defines a circular annulus.

5. The platter of claim 1 wherein said member upper surface are non-slip surfaces.

6. The platter of claim 1 wherein said platter is formed of a plastic selected from the group consisting of polypropylene, polystyrene and polyethylene.

7. The platter of claim 1 wherein said platter is an injection-molded, homogeneous, one-piece integral construction of plastic.

8. The platter of claim 1 wherein at least segments of said flange are disposed substantially inwardly of said member to facilitate grasping of said member when said platter rests on the support.

9. The platter of claim 1 wherein said back defines a plurality of equiangularly-disposed linear ribs extending radially outwardly from the center thereof at least as far as said flange, the positions of said ribs being detectable from above said member to permit said ribs to function as guidelines for dividing an article on said member upper surface into portions of like area.

10. The platter of claim 1 wherein said flange lower surface is spaced by about one centimeter from said member upper surface.

11. The platter of claim 1 wherein said member has only a single supporting flange depending for said member.

12. A pair of back to back nested food platters, each of said platters being adapted to support a food item above a support and comprising a plate having a perimeter, a lower surface or back, and a generally planar upper surface adapted to support the food item thereon; and a flange depending from said plate lower surface and having a lower surface defining a plane spaced below said plate lower surface to space said plate above the support, said flange defining an inner perimeter and an outer perimeter; said platters having plate perimeters of generally like dimensions and flange perimeters of appreciably different dimensions enabling the flange of one of said platters to be nested within the flange of the other of said platters, thereby to enable said platters to be compactly stacked back to back.

13. The pair of claim 12 wherein in each of said platters said flange lower surface is equally spaced from said plate upper surface.

14. The pair of claim 13 wherein in each of said platters said flange lower surface is spaced by about one centimeter from said plate upper surface.

15. The pair of claim 12 wherein in each of said platters said flange defines a continuous, closed hollow shape.

16. The pair of claim 15 wherein in each of said platters said flange defines a circular annulus.

17. The pair of claim 12 wherein in each of said platters the height of said flange spaces said plate lower surface from said flange lower surface, with substantially the entire height of said flange of said one platter being telescopically received within the height of said flange of said other platter.

18. The pair of claim 12 wherein said Plate upper surfaces are non-slip surfaces.

19. The pair of claim 18 wherein said platters are formed of a plastic selected from the group consisting of polypropylene, polystyrene and polyethylene.

20. The pair of claim 12 wherein each of said platters is an injection-molded, homogeneous, one-piece integral construction of plastic.

21. The pair of claim 12 wherein in each of said platters at least segments of said outer flange perimeter are disposed substantially inwardly of said plate perimeter to facilitate grasping of said plate when said platter rests on the support.

22. The pair of claim 12 wherein in each of said platters said plate lower surface defines a plurality of equiangularly-disposed linear ribs extending radially outwardly from the center thereof at least as far as said inner flange perimeter, the positions of said ribs being detectable from above said plate upper surface to permit said ribs to function as guidelines for cutting a food item on said plate upper surface into portions of like area.

23. The pair of claim 12 wherein said outer flange perimeter of said one platter is received within said inner flange perimeter of said other platter.

24. The pair of claim 12 wherein each of said platters has only a single flange depending from said plate lower surface.

25. A platter adapted when used to support an article above a support and when stored to be nested back to back with a mating platter to minimize the storage space required to store the platters, comprising a member having a non-slip planar upper surface adapted to support the article thereon and a back, and a supporting flange depending from said member and having a lower surface defining a continuous, closed hollow shape and lying substantially in a common plane spaced below the plane of said back; at least segments of said flange being disposed substantially inwardly of said member to facilitate grasping of said member when said platter rests on the support; said back defining a plurality of equiangularly-disposed linear ribs extending radially outwardly from the center thereof at least as far as said flange, the positions of said ribs being detectable from above said member to permit said ribs to function as guidelines for dividing an article on said member upper surface into aliquots of like area; said platter being an injection-molded, homogeneous, one-piece integral construction of a plastic polypropylene, polystyrene and polyethylene; the dimensions of said member and the dimensions of the corresponding member of the mating platter being substantially the same and the dimensions of said flange and the dimensions of the corresponding flange of the mating platter being different and enabling said flange of said platter to be nestable within the corresponding flange of the mating platter such that said platter and the mating platter can be nested back to back for storage.

26. A pair of back to back nested food platters, each of said platters being adapted to support a food item above a support and comprising a plate having a perimeter, a lower surface or back and a generally planar upper surface adapted to support the food item thereon; and a flange depending from said plate lower surface and having a lower surface defining a plane spaced below said plate lower surface to space said plate above the support, said flange defining an inner perimeter and an outer perimeter; each of said platters being an injection-molded, homogeneous, one-piece integral construction of plastic; in each of said platters said flange defining a circular annulus with at least segments of said outer flange perimeter being disposed substantially inwardly of said plate perimeter to facilitate grasping of said plate when said platter rests on the support, and the height of said flange equally spacing said plate lower surface from said flange lower surface; said platters having plate perimeters of generally like dimensions and flange perimeters of appreciably different dimensions enabling said outer flange perimeter of one of said platters to be nested within said inner flange perimeter of the other of said platters, with substantially the entire height of said flange of said one platter being telescopically received within the height of said flange of said other platter, thereby to enable said platters to be compactly stacked back to back.

* * * * *